United States Patent [19]

Marchhart

[11] 4,010,313

[45] Mar. 1, 1977

[54] DEVICE FOR EFFECTING A GASTIGHT CLOSURE

[75] Inventor: Helmut Marchhart, Landeck, Austria

[73] Assignee: Donau Chemie Aktiengesellschaft, Vienna, Austria

[22] Filed: Feb. 25, 1976

[21] Appl. No.: 661,298

[30] Foreign Application Priority Data

Mar. 4, 1975 Austria ..... 1643/75

[52] U.S. Cl. ..... 13/33; 13/18

[51] Int. Cl.[2] ..... F27D 3/00; H05B 7/06

[58] Field of Search ..... 13/9, 18, 33

[56] References Cited

UNITED STATES PATENTS

| | | | |
|---|---|---|---|
| 3,210,129 | 10/1965 | Penner | 13/33 U |
| 3,370,119 | 2/1968 | Grimm et al. | 13/9 X |
| 3,471,626 | 10/1969 | DeWeese et al. | 13/18 X |
| 3,564,103 | 2/1971 | Brachschob et al. | 13/33 |
| 3,573,337 | 4/1971 | Grimm et al. | 13/33 |
| 3,604,826 | 9/1971 | Muller | 13/18 |
| 3,737,554 | 6/1973 | Horibe et al. | 13/33 |

*Primary Examiner*—R. N. Envall, Jr.
*Attorney, Agent, or Firm*—Watson, Cole, Grindle & Watson

[57] ABSTRACT

A device for effecting a gastight closure of an inner tube of a hollow electrode of an electrothermal smelting furnace, includes a stub tube attached to the inner tube and an elastomeric deformable closure plug movable within the stub tube and into sealing engagement with both the inner walls of the inner tube and with the stub tube. A rigid pressure transmitter body is embedded within the plug and subdivides it into a section of elastomeric material lying against the inner wall of the inner tube and a section of elastomeric material lying against the inner wall of the stub tube. The two sections are interconnected, and the actuator rod is connected to the section adjacent the stub tube so that, upon the exertion of an inward thrust on the actuator rod, the two sections of the plug are expanded into sealing engagement with the inner walls of the stub and inner tubes.

11 Claims, 4 Drawing Figures

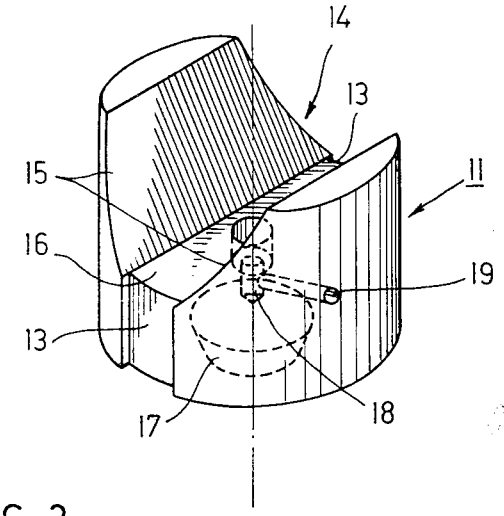
FIG. 3
FIG. 4
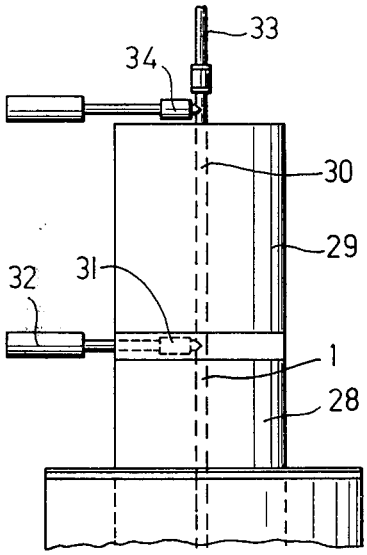

DEVICE FOR EFFECTING A GASTIGHT CLOSURE

BACKGROUND OF THE INVENTION

This invention relates generally to a device for effecting a gastight closure of an inner tube of a hollow electrode of an electrothermal smelting furnace, and more particularly to such a device as having a deformable closure plug which can be introduced into the inner tube from a position inside a stub tube attached to the inner tube in which it is clear of the flow path through the inner tube. The plug can be introduced by means of an actuator rod and can be forced against the wall of the tube to make a seal by application of pressure to the actuator rod.

Hollow electrodes through which electrothermal smelting furnaces are charged with a particulate load, must be lowered at certain intervals of time, depending upon the consumption in the arc, and must be replaced at the top end by another electrode section. Such a section is, as a rule, about 2 meters long. The electrode section comprises sections of an outer sheet steel sheath and of the inner feed tube, the annular space bounded by these being filled with an electrode compound. During attachment of a new electrode section and the necessary interruption of the feeding of the load, in order to prevent escape of poisonous gases, in particular carbon monoxide, through the hollow electrode, the inner tube of the hollow electrode must be closed in a gastight manner. Temporary closure of the inner tube of the hollow electrode may, however, also be necessary when disturbances occur in the operation of the furnace or when repair work must be performed on the hollow electrode.

Regarding a known closure device of the type described, a closure is mounted on the top end of the inner tube of the hollow electrode. The inner tube has a stub at the side for feeding in the load and a stub tube is provided coaxially with the inner tube of the hollow electrode to receive the closure plug in the non-actuated state. If, during the shut-off procedure, the closure plug is slid by means of the actuator rod into the inner tube of the hollow electrode up to a seat, against a stop moved into the inner tube, and is caused, for example by application of pressure to the actuator rod, to enlarge in cross-section, it shuts off the inner tube so that the tube is gastight.

The considerable disadvantage of this known device consists in the fact that a large stroke is necessary for actuation of the shut-off plug and, in addition to the space necessary for the electrode section which is subsequently to be added on, space must also be available above the hollow electrode for the closure device as well as for mounting it on the renewed inner tube of the hollow electrode. The known device also requires a relatively large expenditure of effort, because, depending upon the form of the closure plug, before addition on a new electrode section either the actuator rod must be attached from the closure plug in its sealing position in order to be able to take away the closure, or the actuator rod must, upon removal of the closure, in some way or another be kept under stress. Finally the structural size is also increased by the form and arrangement of the movable stop in the inner tube of the hollow electrode.

SUMMARY OF THE INVENTION

An object of the present invention is to avoid the aforedescribed disadvantages of the known construction of a closure device of the type specified and to provide a closure device which requires little space, does not impede work which has to be performed at the top end of the hollow electrode and is simple to actuate, so that closing of the inner tube of the hollow electrode can be performed, when necessary, with little expenditure of time and effort.

In the present invention, the stub tube is attached to the inner tube at least approximately perpendicular to the axis of the inner tube; the closure plug is of elastomeric material and contains an embedded pressure-transmitter body of rigid material which subdivides the plug into an end section which forms a closed sealing zone of elastomeric material against the inner wall of the inner tube and a section at the end adjacent the stub tube which forms a closed sealing zone of elastomeric material against the inner wall of the stub tube, the two sealing zones lying substantially perpendicular to one another and being connected together; and the actuator rod is coupled directly to the section of the closure plug which is at the end adjacent the stub tube and is coupled indirectly via this section and the pressure transmitter body to the end section of the closure plug.

By this form of construction an exceedingly compact device is created, which, when necessary, enables good gastight closure of the inner tube of the hollow electrode to the obtained. The device can be actuated so that the closure procedure can be effected very rapidly, because the length of the closing stroke of the closure plug corresponds substantially only with the diameter of the inner tube of the hollow electrode.

In a preferred embodiment of the invention, the stub tube has the same inner diameter as the inner tube of the hollow electrode. A further preferred feature of the invention is that the closure plug in the undeformed state has substantially the shape of a cylinder with a hemispherical front end. Moreover, the two sections of the closure plug, which are arranged on the two sides of the pressure transmitter body, are preferably connected together by two strip-like sections of elastomeric material lying diametrically opposite one another on the outside of the pressure transmitter body. Thereby, a good formation of the sealing zones is ensured and the danger of far too rapid wear of the closure plug is reduced because a considerable portion of its outer surface is formed by the outside of the metal pressure transmitter body.

From structural considerations and having regard to the safety of operation, it is found to be particularly advantageous if, according to another preferred feature of the invention, the actuator rod carries at its end a pressure plate which is firmly connected to the section of the plug adjacent the actuator rod, and preferably is embedded in it. The actuator rod can be made hollow, and the pressure transmitter body can be connected to a guide rod which can slide telescopically in the hollow actuator rod. In that case, the guide rod is preferably made hollow and is connected to a flow channel passing through the pressure transmitter body. This form enables inert protective or flushing gas to be introduced into the inner tube of the hollow electrode during closure of the inner tube by the closure plug, whereby safety against escape of furnace gas is further increased and, furthermore, cooling of the closure plug is achieved.

BRIEF DESCRIPTION OF THE DRAWINGS

FIG. 3 is a perspective illustration of a part of the closure plug of the device of FIGS. 1 and 2, and FIG. 4 is a diagrammatic illustration of the use of the closure device in accordance with the invention.

DESCRIPTION OF THE PREFERRED EMBODIMENT

Figure 1:
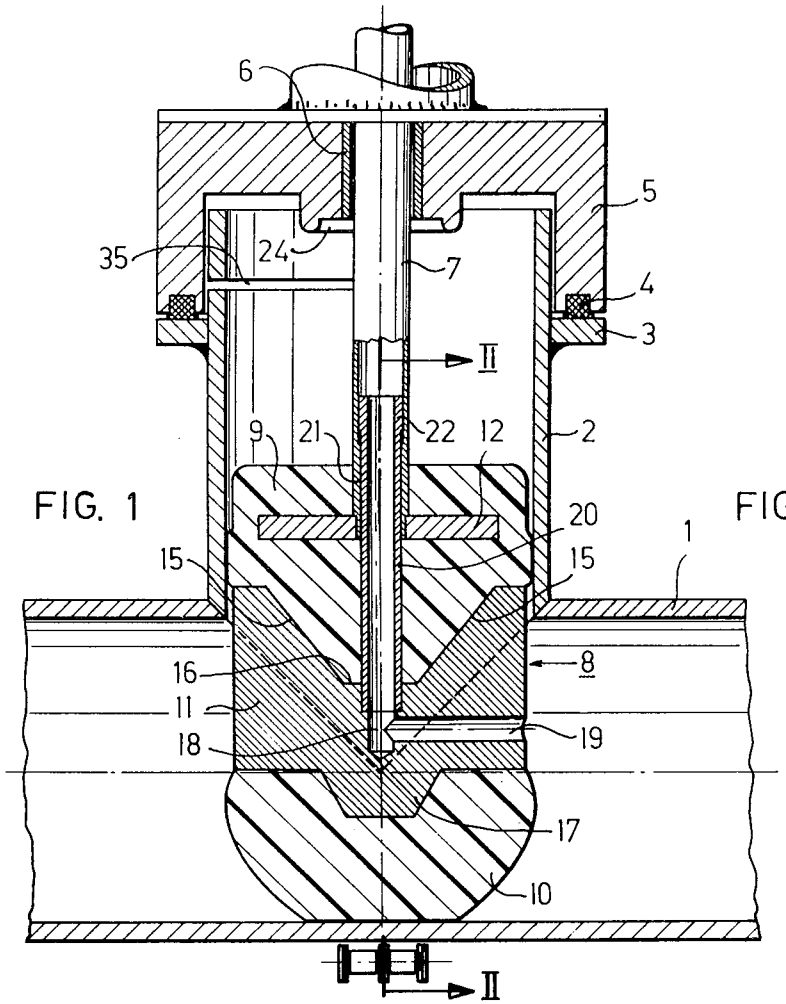
FIG. 1 is an axial sectional view of a closure device in accordance with the invention, in which the closure plug is shown in its closed position.

In FIG. 1 a section of a metal tube 1 is shown, which forms the inner tube of a hollow electrode of an electrothermal smelting furnace. The remainder of the electrode is not illustrated in the interest of clarity. During operation of the furnace, a particulate load is fed continuously into the furnace via this inner tube 1. To the inner tube 1 is attached a stub tube 2 with its axis substantially perpendicular to the axis of the inner tube. The inner diameter of stub tube 2 is preferably equal to the inner diameter of inner tube 1. Stub tube 2 has mounted on its outer surface, spaced from inner tube 1, an annular flange 3 against which the end wall of a bush-shaped closure 5 is urged, to cap the free end of the stub tube. An annular seal 4 is interposed between the end wall and flange 3. Closure 5 is urged toward flange 3 by means of a clamping device which will be more fully described hereinafter. A tubular actuator rod 7 is supported by means of a bearing bush 6 located in an axial bore in closure 5. The actuator rod controls a closure plug 8 which can slide inside stub tube 2.

Closure plug 8 is formed of an elastomeric material, for example rubber or plastics, and contains embedded in it a pressure transmitter body 11 of rigid material, for example metal, which subdivides the plug into a section 9 at the end adjacent the stub tube and an end section 10 adjacent the inner tube. Section 9 of the plug encircles an end section of actuator rod 7 and surrounds an annular disc 12 attached to the end of the rod and extends perpendicular to the axis of the rod. The whole closure plug 8 is, in its relaxed and undeformed condition, substantially in the shape of a cylinder having a hemispherical front end.

Figure 2:
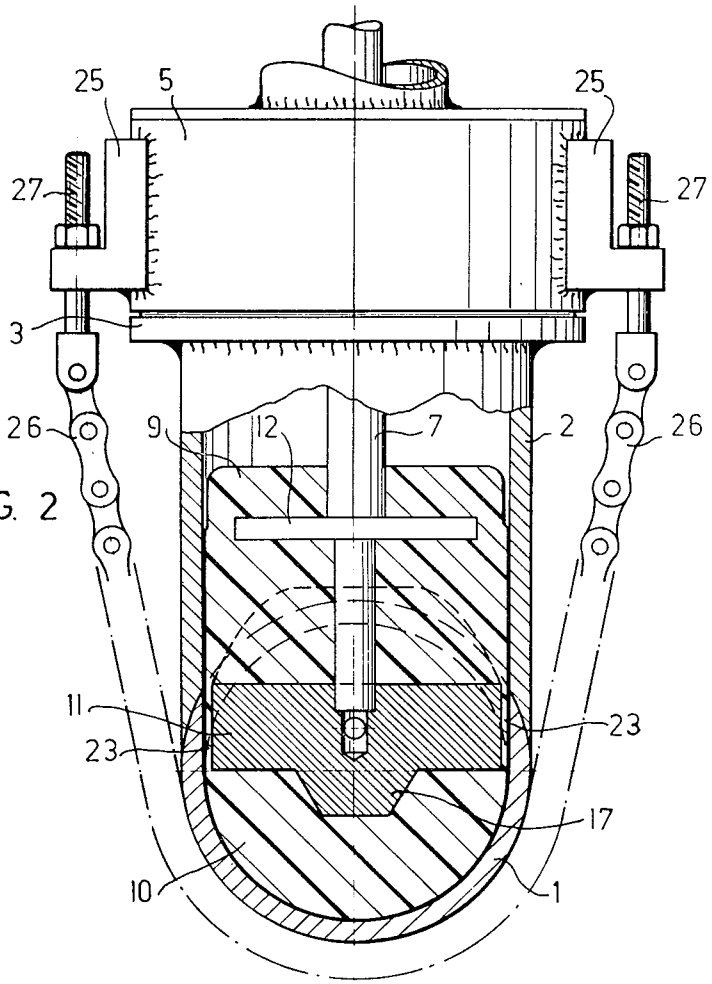
FIG. 2 is a partially sectioned elevational view of the device of FIG. 1, viewed in the direction of arrows II—II of FIG. 1.

As seen in FIGS. 1 to 3, pressure transmitter body 11 has a substantially cylindrical outer surface in which are formed two longitudinal grooves 13 lying diametrically opposite one another. On the end adjacent section 9 of the plug, pressure transmitter body 11 has a recess 14 which is basically V-shaped and is symmetrical with respect to a longitudinal central plane through the plug, lying perpendicular to the axis of inner tube 1. The sides 15 of recess 14, and the planes which contain associated sidewalls of longitudinal grooves 13 lying opposite one another, together form lines of intersection parallel to one another which define between them a bottom face 16 of recess 14, which corresponds with the width of grooves 13. A central frusto-conical projection 17 extends from the face of pressure transmitter body 11 adjacent end section 10 of the plug. Pressure transmitter body 11 also has an axial blind hole 18 from the inner end of which extends a radial bore 19 lying perpendicular to the longitudinal central plane of recess 14 and emerging at the outer surface of the pressure transmitter body. Pressure transmitter body 11 is connected with hollow actuator rod 7 by a hollow guide rod 20 which is seated in an enlarged part of blind hole 18 and extends through section 9 of the plug up into the actuator rod. Guide rod 20 is guided in actuator rod 7 by an axial section 21 of the actuator rod which has a reduced inner diameter and forms a shoulder-stop for a heat section 22 of the guide rod which can slide telescopically in the hollow actuator rod.

As shown in FIG. 2, the two sections 9 and 10 of closure plug 8, formed as one piece of elastomeric material, are connected together by strip-like sections 23 of the material which fill longitudinal grooves 13 in pressure transmitter body 11. The closure plug illustrated is so formed that in its undeformed condition it has an outer diameter which is somewhat smaller than the inner diameter of stub tube 2.

For shutting off inner tube 1 of the hollow electrode, closure plug 8 is slid from a position inside stub tube 2 in which the plug rests against an internal annular projection 24 on closure 5, into inner tube 1 by application of a thrust against actuator rod 7, for example by means of a hydraulic or pneumatic drive mechanism (not shown). The pressure exerted on section 9 of the plug via disc 12 on actuator rod 7, which disc acts as a pressure plate, is transmitted via pressure transmitter body 11 to the substantially hemispherical end section 10 of the plug, which is pressed against the inner wall of inner tube 1. Section 10 thereby assumes a condition of deformation shown in FIGS. 1 and 2, in which it is flattened out at its face and is enlarged in a radial direction to such an extent that it forms a closed strip-like sealing zone against the inner wall of inner tube 1. The sealing zone extends substantially about half the perimeter of the tube up to the region of intersection with stub tube 2. Under the action of the axial force exerted upon the closure plug that part of section 9 of the plug lying between pressure plate 12 and pressure transmitter body 11 is spread out in a radial direction and comes into contact with the inner wall of stub tube 2 to form a closed annular sealing zone. The sideways squeezing-out or displacement of the material of section 9 of the plug is enhanced by V-shaped recess 14 in pressure transmitter body 11, which recess developes a wedge-effect. Since the elastomeric material of section 9 of the plug is also displaced radially outwardly in the region of V-shaped recess 14 and the strip sections of material in the region of longitudinal grooves 13 in the pressure transmitter body are likewise squeezed outwardly by the compression in an axial direction, sealing zones also result in the axial direction along the inner wall of stub tube 2 up to its zone of intersection with inner tube 1. Thus, the closed sealing zones lying perpendicular to one another in contact with the inner wall of the inner tube and the inner wall of the stub tube are interconnected.

The dimensions of the elastomeric sections of the closure plug, the dimensions of the pressure transmitter body, the hardness of the elastomeric material and the magnitude of the thrust against the actuator rod are so chosen that the closure plug can move inside the stub tube without danger of excessive wear, but also forms a good seal in the shut-off position. The relative movement between actuator rod 7 and pressure transmitter body 11, which occurs upon deformation of the closure plug is not impeded by the connection of rod 7 to guide rod 20, because the head of the guide rod can, as described above, slide telescopically within actuator rod 7.

When the flow path through the inner tube of the hollow electrode is to be re-opened, the compressive stress or thrust exerted upon actuator rod 7 is released, whereupon closure plug 8 returns to its undeformed condition. Upon withdrawing actuator rod 7 by any suitable means, the closure plug is drawn completely into stub tube 2 and is preferably maintained against annular projection 24 on closure 5, whereby sealing against escape of gas through bearing bush 6 in closure 5 is effected.

Angle pieces 25 are mounted as by welding on to exterior of closure 5 as shown in FIG. 2, angle pieces 25 lying diametrically opposite one another. The angle pieces have tapped holes in which threaded pins 27, connected to the ends of a chain 26, are adjustably mounted. Chain 26 extends about the exterior of inner tube 1. The unit formed by closure 5, closure plug 8, actuator rod 7, and if necessary also the actuator rod drive (not shown), can be rapidly mounted in stub tube 2 by clamping closure 5 onto stub tube 2 firmly by the clamping device formed by chain 26. The unit can likewise be rapidly dismantled upon removal of the clamping device. Since stub tube 2 must be closed off gastight after removal of the unit, a cut 35 is formed in the stub tube extending about half its circumference and perpendicular to its axis, through which, upon withdrawal of the closure plug, a metal disc can be slid into the stub tube and then welded to the latter to close off the stub tube.

With the closure device in accordance with the invention, using the described form of closure plug 8, i.e. by embedding a pressure transmitter body 11 of rigid material therein, section 9 of the closure plug at the end adjacent stub tube 2 advantageously forms an accurate annular closed sealing zone and end section 10 of the closure plug is squeezed against the inner surface of tube 1 to make a good seal, because the pressure exerted on the closure plug by means of the actuator rod is transmitted uniformly to end section 10 by the pressure transmitter body. Pressure transmitter body 11 provides the further advantage that just in that region of the closure plug which gets most heavily stressed during the closing and opening strokes there is only a small amount of elastomeric material, so that the danger of premature wear of the closure plug is minimized. Finally, in the shut-off condition of the inner tube of the hollow electrode, the aforedescribed embodiment enables an inert protective gas for flushing and/or cooling purposes to be blown in via the actuator rod, the guide rod and the pressure transmitter body into the inner tube in the direction leading to the furnace.

For a more complete understanding of the invention, a hollow electrode of a smelting furnace is illustrated diagrammatically in FIG. 4. The electrode is to be renewed by another electrode section. For this purpose a new section of jacket 29, e.g. 2 meters long, is welded on to the existing jacket section of the hollow electrode, and a corresponding section 30 of inner tube is welded on to inner tube 1 of the electrode, and the annular space produced is filled with Soderberg compound or paste in any normal manner.

In order to prevent noxious gases escaping from the smelting furnace via the inner tube of the hollow electrode during the process of construction, the closure plug of a closure device 31 attached to inner tube 1 is brought into the shut-off position by means of its drive mechanism 32 as in the manner described above. At the same time, inert gas is blown into inner tube 1 via a feed pipe (not shown) and the closure device, so that underneath closure device 31 there is a cushion of inert gas as an additional security. Next, the new section of electrode jacket 29 and the new piece of electrode inner tube 30 together with another shut-off device 34 are welded on so as to connect the piece of pipe 30 to load feed pipe 33. The original shut-off device 31 can then be dismantled by removal of closure 5 and withdrawal of closure plug 8 from stub tube 2, the stub tube being closed off in the manner described. In that case, in order to avoid any danger of an escape of furnace gas, protective gas is blown at high pressure via top closure device 34 into the section of inner tube 30 and inner tube 1.

It is obvious that the described embodiment may be altered in various ways within the scope of the basic idea of the invention, especially as regards the form of the pressure transmitter body and the clamping device. And, obviously many other modifications and variations of the present invention are made possible in the light of the above teachings. It is therefore to be understood that within the scope of the appended claims the invention may be practiced otherwise than as specifically described.

What is claimed is:

1. A device for effecting a gastight closure of an inner tube of a hollow electrode of an electrothermal smelting furnace, comprising a stub tube attached to the inner tube with the axis of the stub tube being substantially perpendicular to the axis of the inner tube; a deformable closure plug of elastomeric material so disposed as to be movable by means of an actuator rod from a position within the stub tube and clear of the flow path through the inner tube, to a position in the inner tube and for sealing whereby it is capable of being forced by pressure on the actuator rod so that the plug expands into sealing contact with the inner wall of the inner tube, the plug containing an embedded pressure transmitter body of rigid material which subdivides the plug into an end section which forms a closed sealing zone of elastomeric material lying against the inner wall of the inner tube, and a section at an end adjacent the stub tube which forms a closed sealing zone of elastomeric material lying against the inner wall of the stub tube, the two sealing zones lying substantially perpendicular to one another and being interconnected; and the actuator rod being coupled directly to the section of the plug which is at the end adjacent the stub tube and being coupled indirectly via this section and the pressure transmitter body to the end section of the plug.

2. A device as claimed in claim 1, in which the inner diameter of the stub tube is equal to the inner diameter of the inner tube.

3. A device as claimed in claim 1, in which the plug in an undeformed condition thereof before the pressure is exerted on the actuator rod is substantially in the shape of a cylinder having a hemispherical front end.

4. A device as claimed in claim 1, in which the two sections of the plug which are arranged at opposite ends of the pressure transmitter body are connected together by two strip-like sections of elastomeric material lying diametrically opposite one another on the outside of the pressure transmitter body.

5. A device as claimed in claim 1, in which the actuator rod carries at its end a pressure plate which is firmly connected to the section of the plug adjacent the actuator rod.

6. A device as claimed in claim 5, in which the pressure plate is embedded in the plug.

7. A device as claimed in claim 1, in which the actuator rod is hollow, and the pressure transmitter body is connected to a guide rod arranged to slide telescopically within the hollow actuator rod.

8. A device as claimed in claim 7, in which the guide rod is hollow and is connected to a flow channel passing through the pressure transmitter body.

9. A device as claimed in claim 5, in which the pressure transmitter body has at its end adjacent the pressure plate a recess which, in a plane of section defined by the axes of the inner tube and the stub tube, is formed substantially in the shape of a V and which extends into the section of the plug which contains the pressure plate.

10. A device as claimed in claim 1, in which the actuator rod is guided slidably in a closure which is separable from the stub tube and is capable of being clamped by means of a clamping device tightly against the stub tube to effect a seal.

11. A device as claimed in claim 10, in which the clamping device comprises a chain looped about the inner tube and is adjustably attached to the closure.

* * * * *